United States Patent [19]

Meacher et al.

[11] 4,362,020

[45] Dec. 7, 1982

[54] HERMETIC TURBINE GENERATOR

[75] Inventors: John S. Meacher, Ballston Lake; David E. Ruscitto, Ballston Spa, both of N.Y.

[73] Assignee: Mechanical Technology Incorporated, Latham, N.Y.

[21] Appl. No.: 233,436

[22] Filed: Feb. 11, 1981

[51] Int. Cl.[3] ..... F01K 11/04

[52] U.S. Cl. ..... 60/657; 60/646; 308/9; 290/52

[58] Field of Search ..... 308/9, 73, 160; 60/657, 60/646; 290/52

[56] References Cited

U.S. PATENT DOCUMENTS

| | | | |
|---|---|---|---|
| 2,576,284 | 11/1951 | Crocchi | 290/2 |
| 2,961,550 | 11/1960 | Dittman | 290/2 |
| 3,024,366 | 3/1962 | Yanagimachi | 290/2 |
| 3,121,908 | 5/1964 | Grotzinger | 308/160 |
| 3,210,553 | 10/1965 | Cummings | 290/4 |
| 3,292,366 | 12/1966 | Rice et al. | 60/2 |
| 3,410,616 | 11/1968 | Dee | 308/9 |
| 3,672,733 | 6/1972 | Arsenius et al. | 308/9 |
| 3,863,454 | 2/1975 | Doerner | 60/669 |
| 3,950,950 | 4/1976 | Doerner et al. | 60/657 |
| 4,044,561 | 8/1977 | Hohr | 60/646 |
| 4,079,263 | 3/1978 | Inoue | 290/52 |
| 4,180,983 | 1/1980 | Maginot et al. | 60/657 |
| 4,191,021 | 3/1980 | Nakamura et al. | 60/657 |
| 4,209,207 | 6/1980 | Schippers et al. | 308/9 |
| 4,301,375 | 11/1981 | Anderson | 290/52 |

OTHER PUBLICATIONS

"Waste Heat Recovery–Purpose Designed, Fully Integrated, Automatically Controlled Packaged Generating Plant", E. P. Crowdy et al., Proc. Imas 76.

*Primary Examiner*—A. Michael Chambers

*Attorney, Agent, or Firm*—Joeph V. Claeys; Arthur N. Trausch

[57] ABSTRACT

A Rankine cycle turbine drives an electric generator and a feed pump, all on a single shaft, and all enclosed within a hermetically sealed case. The shaft is vertically oriented with the turbine exhaust directed downward and the shaft is supported on hydrodynamic fluid film bearings using the process fluid as lubricant and coolant. The selection of process fluid, type of turbine, operating speed, system power rating, and cycle state points are uniquely coordinated to achieve high turbine efficiency at the temperature levels imposed by the recovery of waste heat from the more prevalent industrial processes.

17 Claims, 7 Drawing Figures

42
24
32
16
23
30
22
14
40
26
28
134
34
18
20
44
12
46
48
10
38
36

HERMETIC TURBINE GENERATOR

The Government of the United States of America has rights to this invention pursuant to Contract No. DE-AC05-78ET11389 awarded by the U.S. Department of Energy.

BACKGROUND OF THE INVENTION

This invention relates to hermetic turbine generators, and more particularly to a Rankine cycle turbine generator system for use with low temperature heat sources.

The increasing cost and scarcity of oil has intensified the search for alternative energy sources and more efficient uses of our present energy supplies. An enormous source of energy which in a sense falls within both of these categories is waste heat from industrial processes. This heat, which is often in the range of 250°-1000° F., has been considered in the past to be too low in energy content to warrant the cost of reclaiming for productive use. However, with the cost and scarcity of traditional energy sources increasing at an alarming rate, we believe the economies warrant an effort to develop means for reclaiming this waste heat.

Many industrial processes extensively used in the U.S. today are highly energy intensive; that is, they consume great quanities of energy in operation of the process. Examples of such processes are chemical synthesizing and refining plants for production of urea, ammonia, plastics, rubber, and pharmaceuticals; metal smelting; refining and treating plants for aluminum, steel, coke, taconite, mercury, copper, and the many specialty metal alloys; and other processes such as petroleum refining, paper making, textiles, glass making and fabricating, power generation, ceramics, etc.

Using one of these examples to examine the energy recovery potential, consider petroleum refining. The crude petroleum is heated in a fractional distillation tower, perhaps 150 feet high. In the tower, a vertical temperature gradient is established which determines the petroleum fractions in the ascending stream of vaporized petroleum which will condense at the various levels. The streams of petroleum fractions emerging from the tower are at their condensing temperature which may range from 150°-500° F., at flow rates of as much as 100,000 gallons per hour, and containing heat in excess of 100 million Btu's per hour. This vast quantity of heat is presently rejected to cooling water and thence to the atmosphere via cooling towers or bodies of water, such as rivers or ocean inlets. This heat loss, if converted to electricity, could amount to more than three megawatts for each stream of petroleum fractions coming from the tower or more than 20 megawatts of electric power for a typical refinery. This power, now wasted to the detriment of the environment would greatly contribute to alleviating the current and worsening energy shortage.

The reason that this heat is rejected instead of being recovered and applied to useful work relates essentially to its low temperature. Existing electrical power generation machinery of acceptable efficiency requires heat at an input temperature of approximately 2500° F. These are the only existing machines that can satisfy the industry criterion of efficiency which is represented by a discounted cash flow (DCF) figure of 25%, meaning that the per annum value of the electrical energy produced by the machine must equal at least 25% of its installed cost. The DCF figure for existing electrical generation equipment designed to utilize waste heat from industrial processes has usually been much lower than the threshold 25% figure.

The low DCF figure for waste heat recovery equipment is a direct consequence of the low temperature level of the heat source. The low source temperature forces the thermodynamic power cycle to operate at low temperatures, which results in low cycle efficiency. This is illustrated by considering the Carnot cycle, which is the theoretical, most efficient power cycle operating between a given heat source temperature and a given heat sink temperature. For a heat-rejection or sink temperature of 100° F., a system with a maximum cycle temperature of 2500° F. has a Carnot or maximum theoretical efficiency of 81%, whereas a system with maximum cycle temperature of 300° F. has a Carnot efficiency of only 26%. The actual or real cycle efficiencies are significantly lower than these values due to the imperfections of the system components; waste heat recovery power cycles have actual efficiencies ranging from 10 to 20 percent. This means that only 10 to 20 percent of the heat energy flowing through the system equipment can be converted to useful output power. Heat exchangers are therefore disproportionately large for a given output power. This effect is further compounded by the generally low temperature differentials and pressure drops which must be maintained in process-fluid heat exchangers, which further increases heat exchanger size and cost. In addition, the energy drop of the working fluid through the prime mover of the installation is much lower than with conventional powered generators, so a much greater quantity of the low temperature fluid must pass through the machine to equal the energy output of a much smaller quantity of high temperature working fluid. As a consequence, the prime mover must be much bigger and more expensive than the prime mover for the high temperature system.

A low temperature or waste heat recovery system has one inherent advantage: the energy input is "free" in the sense that it is supplied by heat which would otherwise be wasted. This advantage is an increasingly significant one, but has remained an insufficient economic advantage to overcome the inherent disadvantages mentioned previously. Thus, to become economically attractive, a system must provide other advantages, such as low initial cost, high component efficiencies, low maintenance cost, high reliability (i.e. low downtime), small space requirements, speed and ease of installation, and durability (longevity).

SUMMARY OF THE INVENTION

Accordingly, it is an object of this invention to provide an electric generating system utilizing waste heat from industrial processes that achieves high component efficiencies, and requires minimal maintenance effort and expense. The system is reliable and durable and can be installed quickly and easily in a small space. Considering its high reliability, longevity, and efficiency, and its low maintenance cost, the system provides a DCF well in excess of the industry threshold of 25%.

These and other objects are met in a system having a Rankine cycle turbine, and electric generator, and a feed pump all on a single shaft and enclosed within a hermetically sealed case. The shaft is vertically oriented with the turbine exhaust directed downward and the shaft supported on hydrodynamic fluid film bearings using the process fluid as lubricant and coolant. The selection of process fluid, type of turbine, operating speed, system power rating, and cycle state points are uniquely coordinated to achieve high turbine efficiency at the temperature levels imposed by the recovery of waste heat from the more prevalent industrial processes.

DESCRIPTION OF THE DRAWINGS

The invention and its objects and advantages will become more clear upon reading the following description of the preferred embodiment in conjunction with an examination of the accompanying drawings, wherein.

DESCRIPTION OF THE PREFERRED EMBODIMENT

Figure 1:
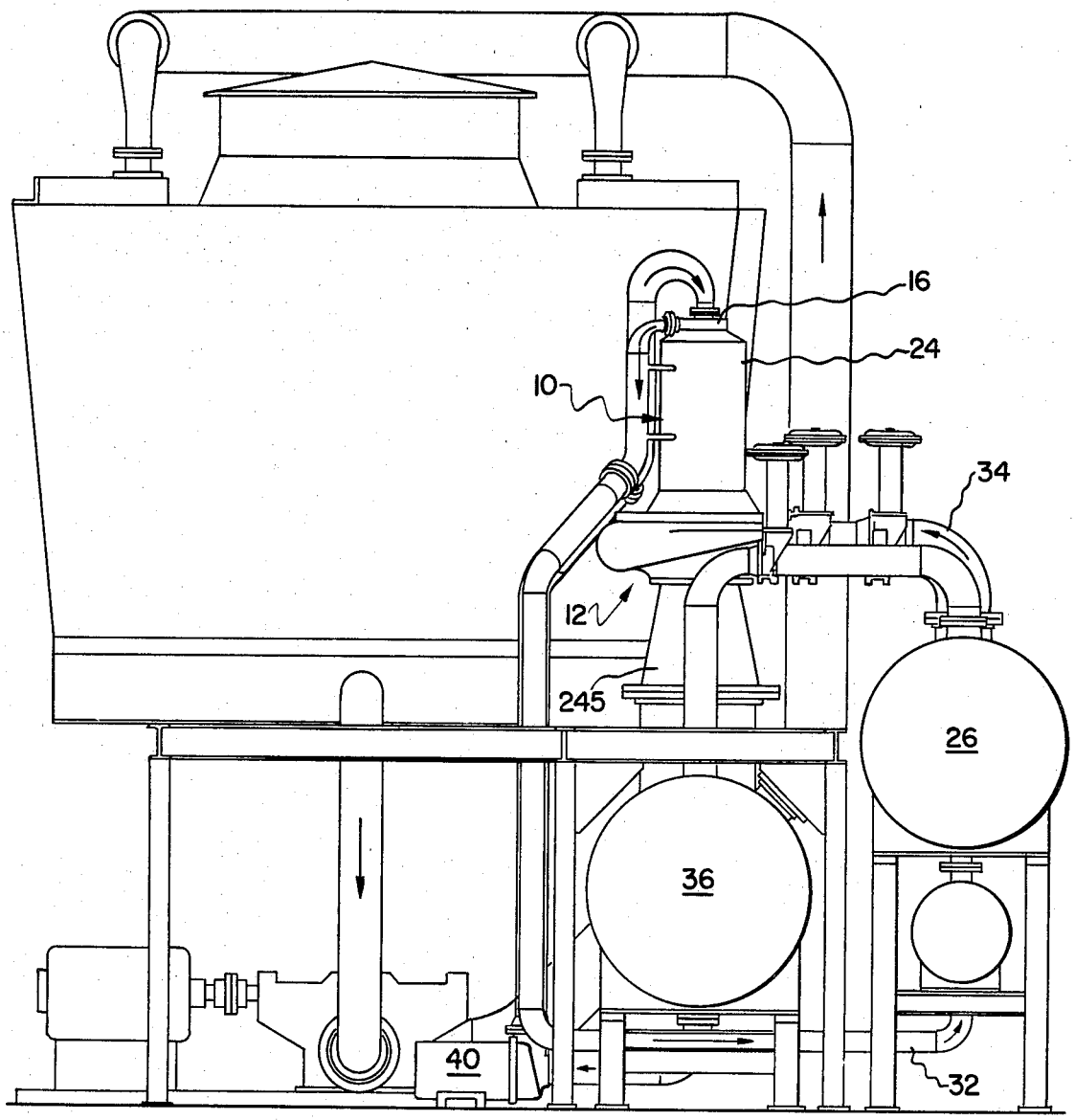
FIG. 1 is an installation diagram showing the invention connected to its related equipment.
Figure 2:
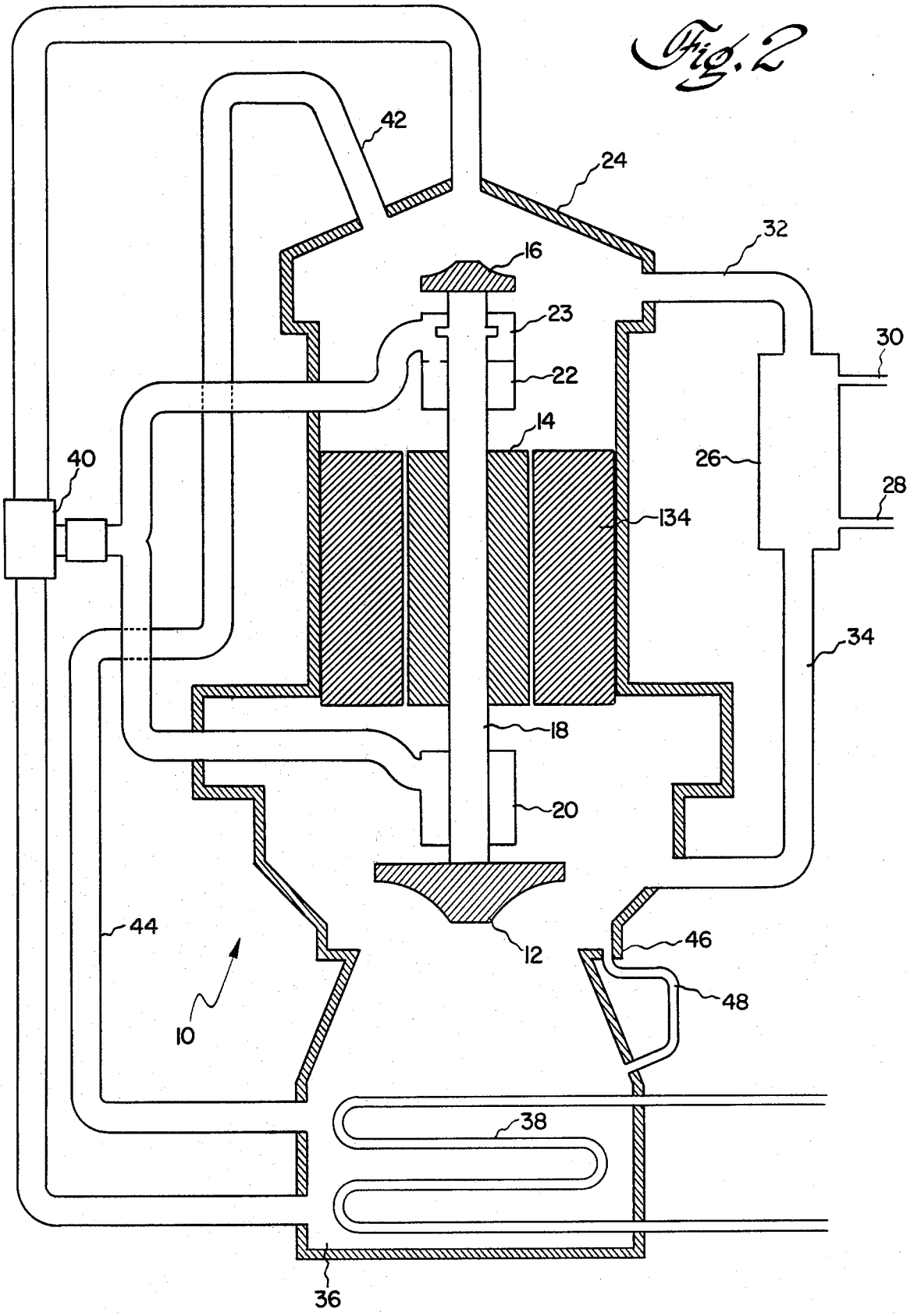
FIG. 2 is a schematic diagram of the invention.

Referring now to the drawings wherein like reference characters designate identical or corresponding parts, and more particularly to FIGS. 1 and 2 thereof, a Rankine cycle power system is shown having a power unit 10 which incorporates a rotor assembly including vapor turbine 12 driving an induction generator armature 14 and a feed pump impeller 16 all affixed to a shaft 18. The shaft 18 is journaled for rotation on a lower journal bearing 20, an upper journal bearing 22, and a thrust bearing 23. The rotor assembly and bearings are all enclosed within a hermetic housing 24. A heat exchanger 26 having inlet and outlet pipes 28 and 30 for a hot process fluid, whose heat is to be recovered by this system, is connected to the power unit 10 by way of a liquid line 32 and a vapor line 34 for conveying liquid working fluid from the pump 16 through the heat exchanger 26 where it is vaporized and the vapor is fed to the turbine 12. A condenser 36 having cooling coils 38 receives the exhaust vapor from the turbine 12 and condenses it to a liquid. A boost pump 40 pumps the liquid working fluid to the feed pump 16 to provide a sufficient suction head for the pump 16 and also pumps liquid working fluid to the bearings 20–23 for lubrication and cooling purposes. A vapor vent 42 is provided in the upper portion of the housing 24 to vent vapor via a line 44 to the condenser, and a liquid drain 46 is provided in the housing 24 to drain liquid working fluid via a line 48 to the condenser 36.

Figure 3:
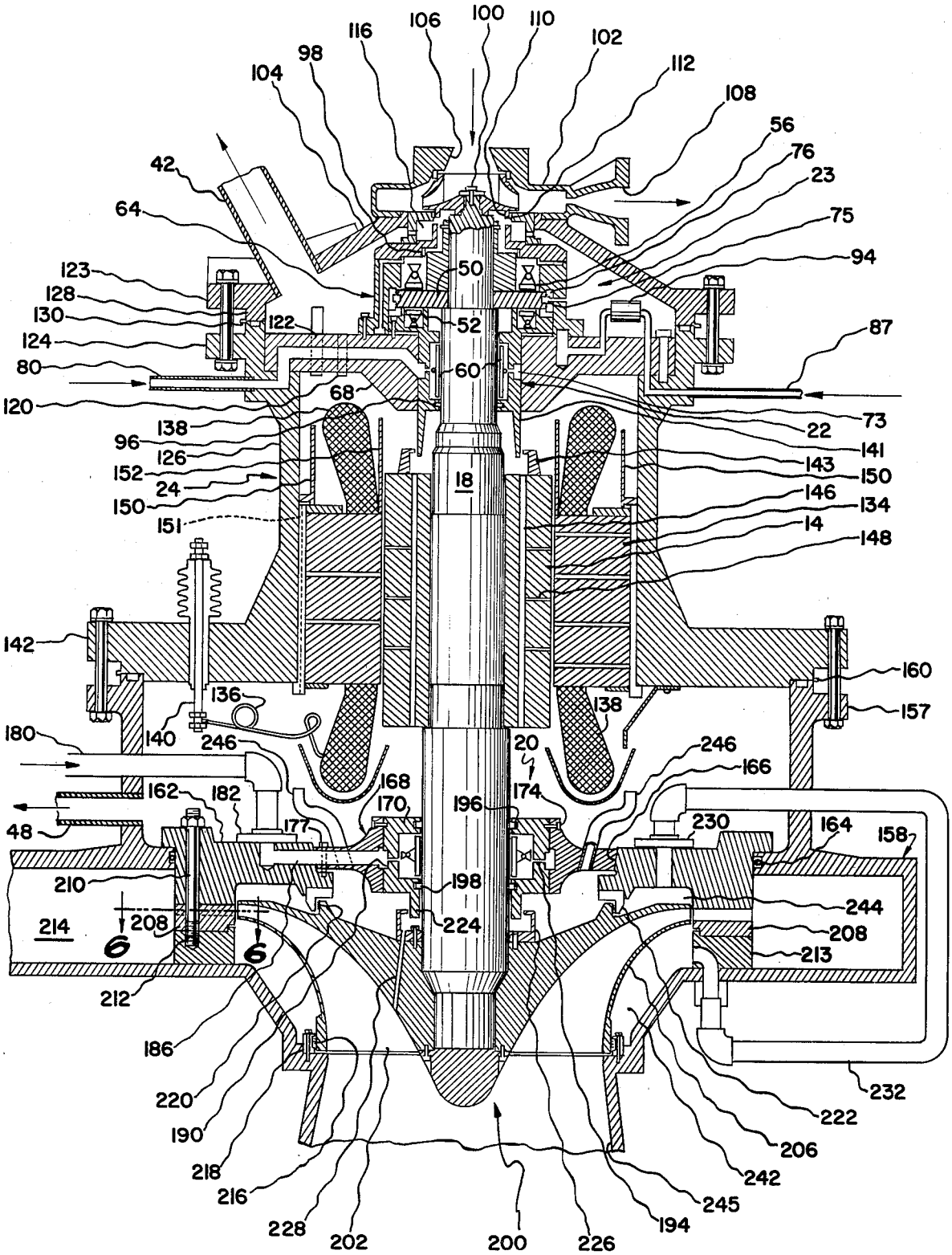
FIG. 3 is a sectional elevation of the hermetic power unit.
Figure 4:
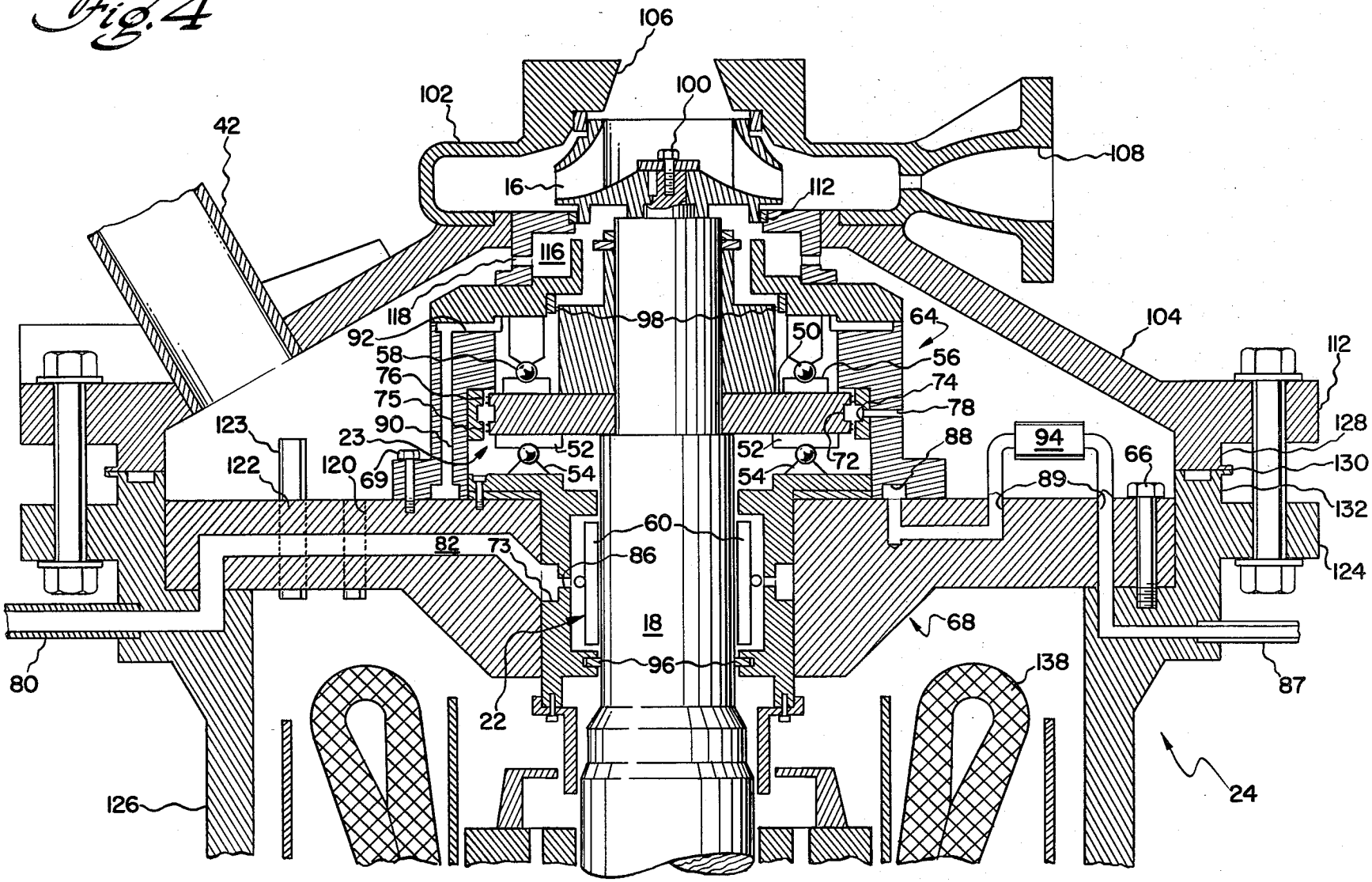
FIG. 4 is a sectional elevation of the upper portion of the hermetic power unit shown in FIG. 3.

Turning now to FIGS. 3 and 4 the power unit 10 shown in FIG. 2 is shown in more detail. The shaft 18 is supported vertically on the thrust bearing 23 which includes a thrust runner 50 attached to and rotating with the shaft 18. For supporting the thrust runner vertically, a plurality of thrust bearing tilt pads 52 are positioned beneath the runner 50 supported on pivots 54 that enable the tilt pads 52 to assume the correct profile to achieve an optimum hydrodynamic supporting fluid film between the runner 50 and the tilt pads 52. A corresponding set of tilt pads 56 and pivots 58 are provided above the thrust runner 50 for resisting upward axial thrust of the rotor assembly.

The upper journal bearing 22 is positioned beneath the thrust bearing 23. It includes a plurality of journal bearing tilt pads 60 in bearing engagement with the shaft 18 and supported by pivots which enable the tilt pads to assume the correct orientation with respect to the shaft to generate a supporting hydrodynamic fluid film between the tilt pads 60 and the surface of the shaft 18.

The upper journal bearing 22 and the thrust bearing 23 are contained in a common bearing casing 64. The bearing casing 64 is secured to a bearing pedestal 68 by bolts 69, and the pedestal is secured to the inside of the hermetic housing 24 by bolts 66. The common bearing casing 64 is maintained full of working fluid under pressure by the boost pump 40 which pumps the lubricating process fluid into the bearing casing 64 from outside the hermetic housing 24 through fluid passages in the pedestal 68. Leakage of process fluid from the lower portion of the bearing casing 64 into the generator cavity is controlled by the use of controlled leakage seals 96 and 75 in the bearing casing 64 and on the lower portion of the thrust runner 50, respectively. Likewise, leakage of pressurized lubricating process fluid from the upper thrust bearing is restricted by a controlled leakage seal 98 and seal 76 on the upper portion of the thrust runner 50. The upper and lower thrust bearing cavities are pressurized separately for a purpose of which will appear presently.

The outside periphery of the thrust runner has a central groove 72 which aligns with a corresponding groove 74 in the inside wall of the housing 64. The two seals, 76 and 75 are located on the outer periphery of the runner 50 above and below the groove 72, and on the corresponding surfaces of the inside of the housing 64. A series of vent holes 78 communicate between the grooves 72/74 and the interior of the hermetic housing 24 to drain the fluid which leaks through the seals into the grooves 72/74.

The fluid supply lines for the bearing casing 64 include a fluid supply line 80 attached to the housing 24 and communicating with a drilled passage 82 in the pedestal 68 which communicates with an annular groove 73 through which liquid is supplied to the inside of the bearing casing 64 by way of a series of holes 86 drilled through the bearing casing and communicating between the groove 73 and the interior of the bearing.

A second fluid supply line 87 is connected to the housing 24 and communicates by way of a drilled passage 89 in the pedestal 68 to an annular groove 88 which feeds another annular groove 92 through vertical holes 90. The upper annular groove 92 supplies the upper thrust bearing. Fluid flow in the passage 89 is controlled by a valve 94 positioned within the hermetic case 24.

The operation of the upper bearing assembly will now be described. Before the machine is started, the entire weight of the rotor is borne on the lower thrust bearing tilt pads 52. The support system is designed to lift the rotor weight off the thrust bearing tilt pads 52 before the rotor begins to turn to reduce starting torque and prolong the life of the bearings. The lubricant used in the bearings is Freon 113 which is the working fluid for the Rankine system. The lubricity of Freon 113 is low and therefore the starting torque for the rotor, if its full weight rested on the thrust bearing tilt pads 52, would be quite high. For this reason, the lower thrust bearing cavity below the thrust runner 50 is pressurized with working fluid by the boost pump 40 through the fluid line 80, while the valve 94 remains closed and prevents the bearing cavity above the thrust runner 50 from being pressurized. The upward hydraulic force acting on the under surface of the thrust runner 50 lifts the weight of the rotor off the tilt pads 52, enabling the runner to run on a hydrostatic cushion of fluid during the start-up period. Leakage from the pressurized lower portion of the bearing casing 64 runs into the drain groove 72/74 and out through the vent holes 78 into the interior of the case 24 so that the upper thrust bearing does not become prematurely pressurized with working fluid. When the rotor has reached sufficient speed to make the hydrodynamic action of the thrust tilt pads 52 effective, the valve 94 opens and allows working fluid to enter the upper thrust bearing above the runner 50 so that the hydraulic pressure above and below the runner 50 is equalized and the axial thrust of the rotor is now borne entirely by the tilt pads 52 and 56. The discharge pressure from the main feed pump 16 connected to the valve 94 by a line (not shown) supplies the force to operate the valve 94, and therefore, no additional controls are required.

The pump impeller 16 is keyed to the top end of the shaft 18 and attached thereto by a screw 100 or the like. The pump impeller 16 is contained within a pump housing 102 which is integral with or attached to the top cap 104 of the hermetic housing 24. The pump housing 102 includes an axial inlet opening 106 and a radial outlet 108. The back face of the pump impeller 16 includes a seal flange which forms a seal 112 with the facing internal surfaces of the top cap 104. Any liquid which leaks past the seal 112 drains through a space 116 and out through a series of drain holes 118 into the interior of the housing 24. Likewise, any liquid which leaks out of the top controlled leakage seal 98 drains into the same space 116 and out through the drain holes 118 into the interior of the housing 24. The placement of the seals 75 and 98 ensures that any Freon vapor that forms inside the bearing casing 64 is immediately purged from the casing to the interior of the housing 24.

A series of drain holes 120 are formed through the pedestal 68 to permit the fluid which leaks past the seals 98, 75, 76 and 112 to drain into the lower portion of the hermetic housing 24. A series of vapor vents 122 having upstanding pipes 123 are formed through the pedestal 68 to permit vapor to pass from the lower portion of the housing 24 into the upper portion and out through the vent 42.

The top cap 104 of the hermetic housing 24 terminates at its lower edge in a radial flange 112 which is bolted to a corresponding radial flange 124 at the top edge of a stator housing 126, which is the central portion of the hermetic housing 24. A lower lip 128 of the top cap 104 can be seal welded at 130 to a top lip 132 of the stator housing 126 to insure integrity of the hermetic seal between the top cap and the stator housing 126. The seal weld 130is a shallow weld and may be removed with a pneumatic chisel or grinder to gain access to the hermetic case 124 if necessary.

An induction generator stator 134 is fastened to the inside of the stator housing 126 in radial alignment with the generator armature 14 which is fastened to and rotates with the shaft 18. A synchronous generator may be used in place of the induction generator. Four lead wires 136 run from the end windings 138 of the generator stator 134 to electrical pass-throughs 140 in a lower flange 142 on the bottom of the stator housing 126.

The cooling of the generator is accomplished by fluid leakage from the top bearing assembly and pump. The lubricant for the bearings is the working fluid for the power unit, which is trichlorotrifluorethane, $CCl_2F—CClF_2$. The liquid in the bearing cavities is maintained in a pressurized subcooled state to insure that addition of small amounts of heat do not produce vapor in the bearing cavity, which would impair the proper functioning of the fluid as a hydrodynamic lubricant in the bearings. This subcooled state is achieved by maintaining the liquid in the bearing cavities at the high pressure level provided by the boost pump 40 connected to the fluid lines 80 and 86. Rather than prevent the leakage of this high pressure fluid from the bearings, the invention limits the leakage and utilizes the leaking fluid to cool the generator. For this purpose, the seals 75, 76, 96, 98 and 112 act more as restrictions than as seals thereby keeping the cost of the seals low and permitting a substantial flow of liquid working fluid into the generator cavity.

The liquid from the top seals 75, 76, 96, 98, and 112 drains through the drain holes 120 in the pedestal 68 and pours directly down onto the generator end turns 138. The liquid from the lower seal 96 is directed down onto the generator armature 14 by a stationary deflector 141 and a cylindrical catcher 143 which is attached to the rotor 14. The liquid retained in the catcher 143 drains downward through a series of vertical holes 146 through the armature 14 and is then radially outward through radial openings 148 in the armature and into the gap between the armature and stator. The liquid that falls onto the end turns 138 of the generator stator 134 is held in place by a pair of annular dams 150 and 152 that maintain a level of liquid around the end turns 138. Liquid overflow from the dam 150, which is slightly lower than the dam 152, passes behind the stator 134 and runs down through a set of axial slots 151.

As the liquid working fluid absorbs heat from the generator, some of it changes state to a vapor and rises upwardly through vents 122 in the pedestal 68 and thence through the vent 42 in the top cap 104 of the housing 24. The liquid which does not vaporize passes downwardly through the generator and outward through a drain 48 to the condenser 36. Both liquid and vapor phases carry heat away from the bearings and generator where it is rejected to the condensor.

Figure 5:
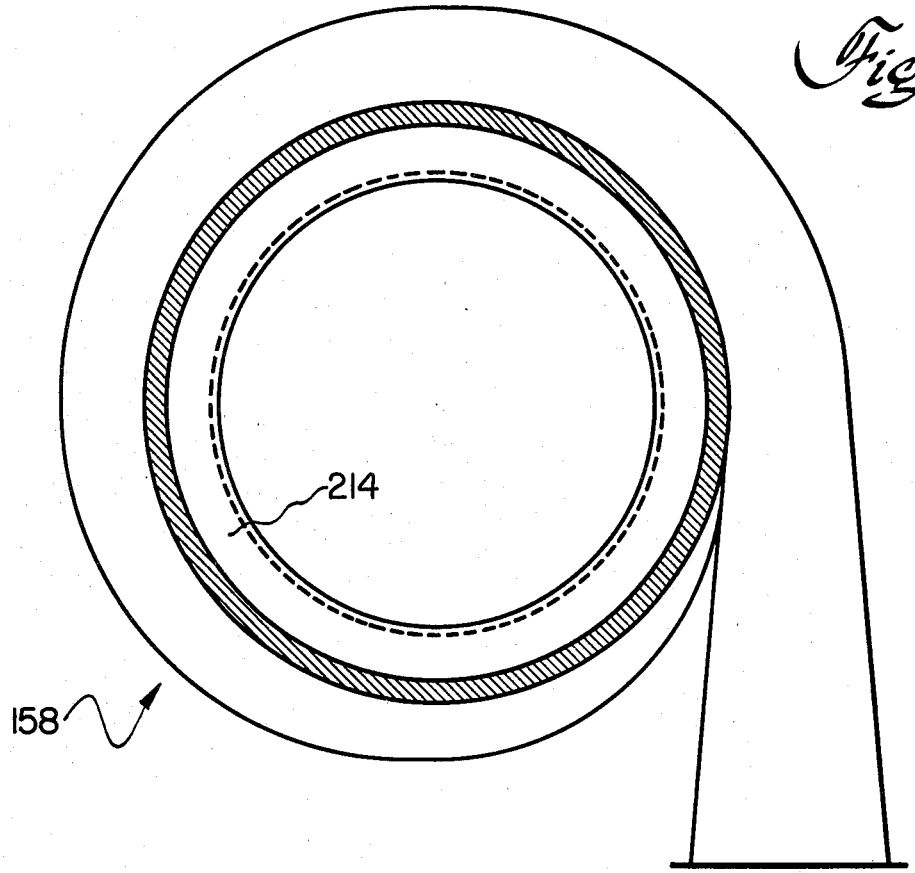
FIG. 5 is a plan view of the turbine inlet housing showing the volute.

The lower flange 142 of the stator housing 126 is bolted to an upper flange 157 of a turbine inlet housing 158 in the form of a volute shown in FIG. 5 which is the lower section of the hermetic housing 24 and contains a turbine wheel 200. The stator housing 126 can be sealed to the turbine inlet housing 158 by a seal weld 160 in the same manner that the top cap 104 was sealed to the stator housing 126.

A lower bearing pedestal 162 is mounted inside the volute 158 by means of studs 210. A seal such as an O-ring 164 prevents high pressure vapor in the volute from leaking into the generator cavity. A pair of clamp blocks 168 fit into a tapered seat 166 in the pedestal 162 and grip a lower journal bearing housing 170. The clamp blocks 168 are attached to the bearing pedestal 162 by bolts 177 and to the bearing housing 170 by bolts 174. The lower bearing housing 170 and the clamp blocks 168 are split for ease of assembly.

The lower bearing pedestal 162 has a fluid line 180 attached to a mounting flange 182. The fluid line 180 communicates with an external source of liquid working fluid, such as the same pump 40 which pressurizes the fluid lines 80 and 87. A passage 186 is drilled into the lower bearing pedestal 162 for conveying liquid working fluid from the fluid line 180 to the bearing housing 170 where they communicate with an annular groove 190 in the bearing housing 170. A series of holes 194 communicate between the groove 190 and the interior of the bearing housing 170 to pressurize the interior of the bearing housing 170 with liquid working fluid for lubrication and cooling purposes. A top seal 196 and a bottom seal 198 restrict the escape flow of fluid out of the bearing housing and maintain the pressure inside the bearing cavity for the same purpose as described for the upper bearing.

Figure 6:
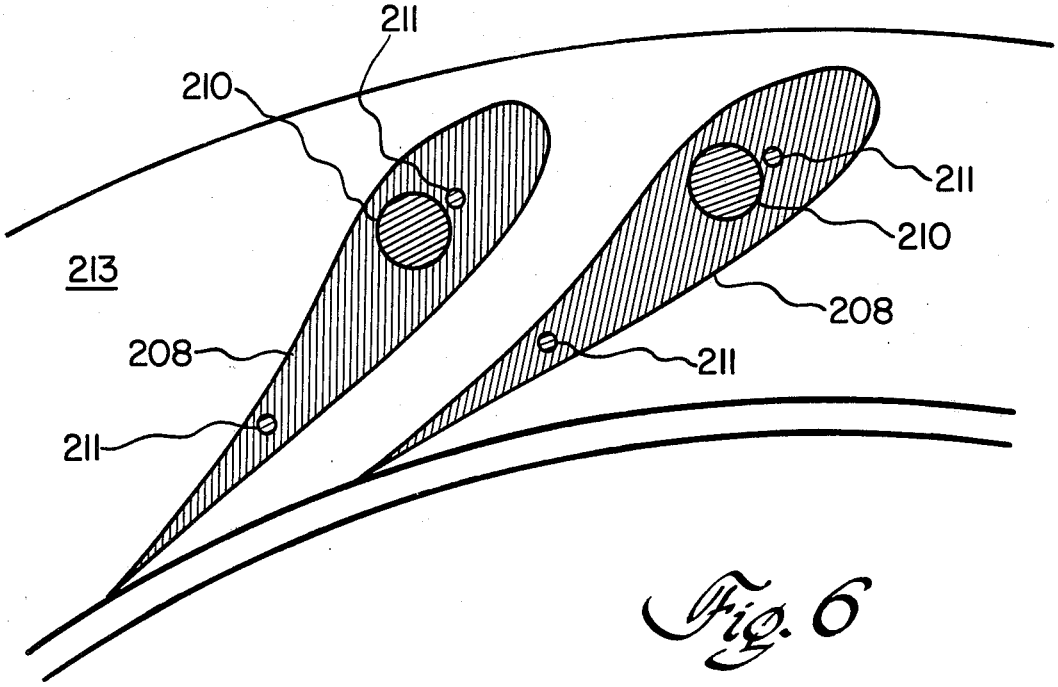
FIG. 6 is a sectional plan view of a portion of the nozzle guide vanes between the volute and the turbine wheel.

A turbine wheel 200 having blades 202 is keyed to the bottom of the shaft 18 and fastened thereto by conventional means. An integral shroud 206 is formed on the turbine wheel 200 and rotates with it. The lower bearing pedestal 162 sits on a series of nozzle vanes 208 shown in FIG. 6, each of which has a hole formed therethrough which aligns with a series of holes in the bearing pedestal. Each hole receives a mounting stud 210, which is threaded into a threaded hole 212 formed in a mounting ring 213 on the volute. The mounting studs 210 securely hold the pedestal in place and, in conjunction with a pair of locating pins 211 in each vane, hold the nozzle vanes at the proper orientation. The high pressure working fluid vapor enters the turbine in a high velocity flow through the nozzle vanes 208 from the circumferential passage 214 of the volute 158 and expands through the turbine wheel and then is exhausted axially into a diffuser 245. The reaction of the downwardly directed turbine exhaust tends to support the weight of the rotor, thereby decreasing the load on the thrust bearings and the drag exerted thereby on the rotor.

The lower edge of the shroud 206 has formed thereon a labyrinth seal 216 which mates with a corresponding seal ring 218 bolted to the inside of the lower lip of the turbine inlet housing 158. At the same radius from the shaft center line as the seal 216/218, a seal flange 220 is formed on the back face of the turbine wheel 200 cooperating with a seal flange 222 formed on the lower face of the bearing pedestal 162. The seals 216/217 and 220/222 reduce leakage of high pressure fluid around the turbine wheel 200. The two seals are at the same radius to equalize the force exerted by the pressurized vapor on the front and back side of the turbine wheel. A balance line 232 communicates between a chamber 244 behind the turbine wheel and a chamber 242 ahead of the turbine wheel shroud 206 to equalize the pressure of each side of the turbine wheel. The lower end of the volute 158 flares to a diffuser 245 to regain some of the residual energy of the working fluid stream.

The lower end of the journal bearing 170 is extended in a ferrule 224 below a cylindrical flange 226 fastened to the back of the turbine wheel 200 near the shaft 18. A series of holes 228 are drilled completely through the turbine wheel 200 opening on its back side on the inside of the flange 226 and on the front side at the outlet face of the turbine wheel. The holes 228 are drilled angling slightly outward so that the radial position of the inner opening at the back face of the turbine is less than its radial position from the center line of the opening at the forward face of the turbine. The fluid leaking from the lower end of the journal bearing drains down between the shaft 18 and the ferrule 224 and is caught by the flange 226 which acts as a fluid dam. The centrifugal force then throws the fluid through the hole 228 by virtue of its slightly outward orientation so that excess fluid does not collect in the space behind the turbine wheel.

Large vapor vents 246 allow the working vapor which leaks radially inward past the seal 220 to vent upward through the clamp blocks 168 to the main generator cavity. From this region, liquid and vapor leakage is conducted to the system condenser via the drain pipe 48.

AERODYNAMICS

The turbine is a radial-inflow type, with the working fluid admitted from the inlet valute housing 158 through the nozzle guide vanes 208. The exit diffuser 245 is provided to utilize all the available energy in the gas before it enters the system condenser. The integral shroud 206 on the turbine wheel 200 eliminates over-the-blade leakage.

The turbine drives the generator to produce one megawatt at 3640 rpm when the system is operating at 230° F. saturation temperature in the boiler, giving 79.64 psia turbine inlet pressure, and 94° F. condenser temperature, corresponding to 9.28 psia condenser pressure. The turbine proximity to the condenser 36 in the installation allows for negligible pressure loss and the diffuser permits a recovery of about 1.5 psi of the remaining dynamic head at the turbine exit. This enables the selection of an 8.0 psia exducer static pressure, resulting in 9.5 psia static pressure at the diffuser exit. The remainder of the pressure difference is comprised of the unrecoverable dynamic head in the gas stream.

The turbine in this system will always operate at or near its design point, so the design point is chosen to optimize the turbine and system efficiency. This is accomplished by selecting a turbine geometry that obtains the best performance as shown in the $N_s$-$D_s$diagram of FIG. 7.

Figure 7:
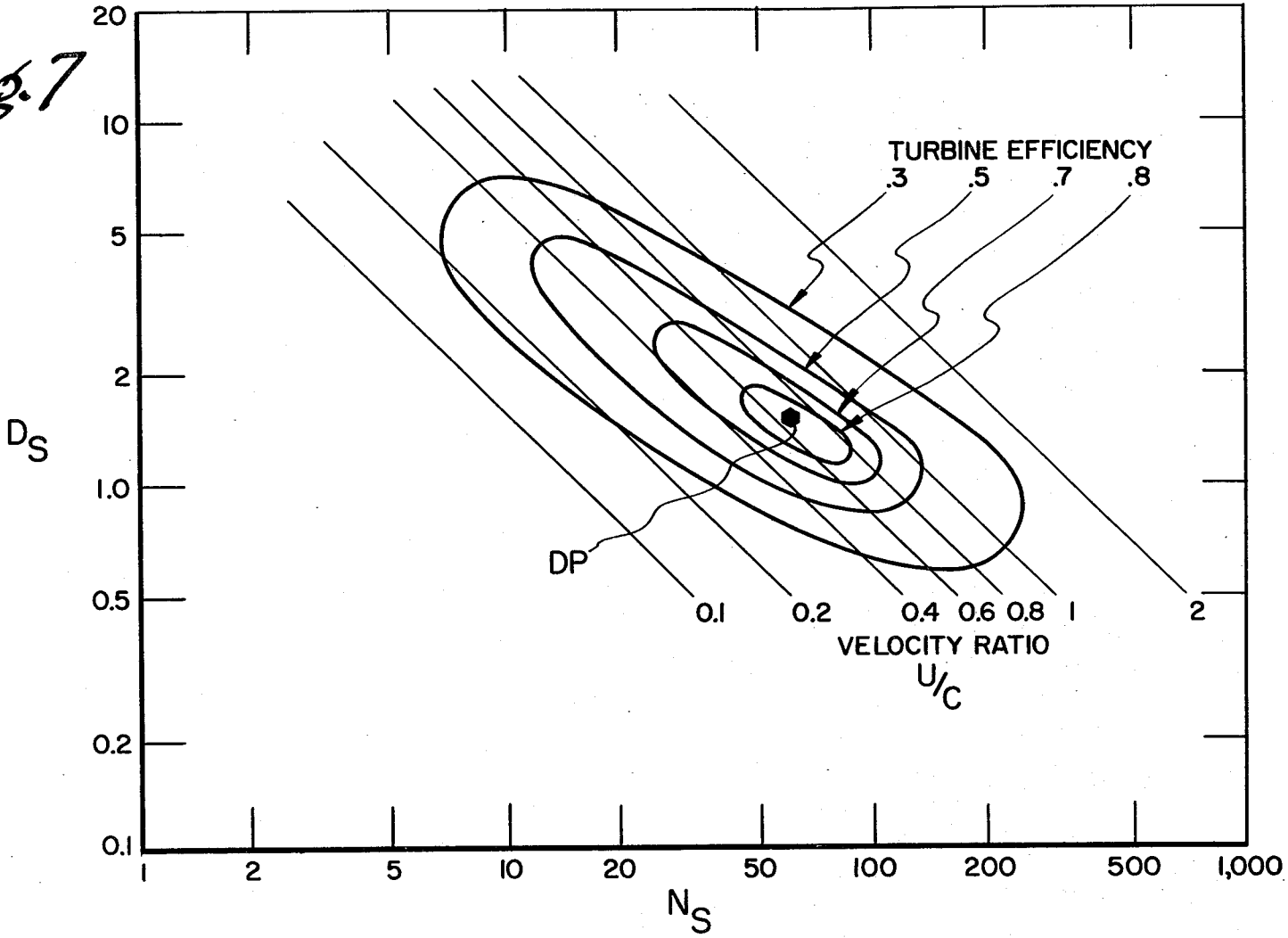
FIG. 7 is a graph of specific speed versus specific diameter showing the design point of the invention.

The turbine efficiency is depicted in FIG. 7 as a function of specific speed ($N_s$) and specific diameter ($D_s$). Specific speed is defined as $$N_s = \frac{N\sqrt{V_1}}{(Had)^{\frac{3}{4}}},$$

and specific diameter is defined as $$D_s = \frac{D(Had)^{\frac{1}{4}}}{\sqrt{V_1}}, \text{ where}$$

N = turbine wheel rpm

V = working fluid flow through the turbine wheel in cubic feet/sec, evaluated at turbine-exhaust conditions Had = adiabatic head drop across the turbine in ft. lb./lb., and D = turbine wheel diameter in feet The design point (DP) is shown in FIG. 7 near the center of the family of efficiency curves, illustrating the optimal results produced by this invention. To achieve this "direct hit" on the efficiency curve "bullseye" within the contraints of predetermined heat and temperature input conditions and cost, it was necessary to select the working fluid for its thermodynamic characteristics, select the head and flow rate for the input conditions, and design the turbine. The myriad variables in these design possibilities must each be correctly chosen to produce the desired result.

The exit recovers an estimated amount of dynamic head of approximately 50 percent at 75 percent efficiency. This gives an area ratio of 1.73. The diffuser cone angle of 15° and L/D=1.22 was selected, resulting in a diffuser exit diameter of 27 inches as shown in FIG. 7.

The turbine disclosed herein is a low cost, rugged single stage, radial inflow type producing 1500 HP from the low level heat normally wasted in a process fluid stream at about 325° F. A considerable amount of heat is available in the process fluid stream from which the waste heat is to be recovered in the range of 30 million BTU/hr, but the low temperature has made recovery impractical in the past. This temperature is normally considered too low for a heat source for a power generating cycle and this heat is normally rejected to the atmosphere in a cooling tower or the like. The high efficiency made possible by this turbine, operating at its design point at about 84 percent efficiency, and efficiently converting the turbine power to electric power, with little mechanical or fluid losses incurred in the unified, compact design, make this invention an economically attractive proposition for the recovery of this heretofore wasted heat. This invention utilizes the existing cooling tower to cool the cooling water which circulates through the cooling coils 38 of the condenser 36. Thus, one of the largest and most expensive components of this installation is normally already in place thereby reducing the installation cost of this invention.

Obviously, numerous modifications and variations of the disclosed embodiment are possible in view of this disclosure. Therefore, it is to be expressly understood that these modifications and their equivalents may be practiced while remaining within the spirit and scope of the invention as defined in the following claims wherein, we claim:

1. A power generating system for recovering energy from a low temperature heat source that includes a heat exchanger for transferring energy from a low temperature source to a low boiling point refrigerant to vaporize said refrigerant, a sealed housing for supporting a rotor shaft vertically therein, a feed pump secured to the upper end of the shaft for pumping vapor from the heat exchanger to the inlet of a turbine secured to the lower end of the shaft to drive an electrical generator operatively connected to the shaft intermediate said feed pump and said turbine whereby the turbine supports at least a portion of the rotor when it reaches operational speed, a condenser connected to the housing directly beneath the turbine for reducing refrigerant vapors discharged from the turbine to a liquid, an upper bearing means connected to said shaft between said vapor pump and said generator, a lower bearing means connected to said shaft between said turbine and said generator, a boost pump for moving refrigerant from the condenser to the feed pump and into both said bearing means whereby said refrigerant is permitted to gravity flow through said bearing means to cool and lubricate said bearing means, and flow directing means for gravity feeding liquid refrigerant leaving the upper bearing means over the surfaces of the electrical generator for cooling said generator.

2. The system of claim 1 wherein said upper bearing means includes a first journal bearing and a second thrust bearing.

3. The system of claim 2 wherein said thrust bearing is a tilt pad bearing that includes a thrust runner secured to the shaft and means to pressurize the thrust bearing region above and below the runner with liquid refrigerant delivered from said boost means.

4. The system of claim 3 that further includes a control means for pressurizing the thrust bearing region below the thrust runner prior to the turbine reaching operational speed to help support the rotor shaft during start-up.

5. The system of claim 4 wherein said control means further includes a valve means for automatically pressurizing the thrust bearing region above the thrust runner once the turbine reaches operational speed to apply equal pressure to either side of the thrust runner.

6. The system of claim 1 wherein said generator has a plurality of flow channels formed therein for conducting liquid refrigerant delivered from the upper bearing means through the generator.

7. The system of claim 6 wherein said flow channels include a series of vertical passages passing through the generator whereby liquid refrigerant flows under the influence of gravity therethrough and a series of horizontal passages communicating with the vertical passages whereby liquid refrigerant is forced therethrough as the generator is turned about the vertical axis of the shaft.

8. A power unit for a Rankine cycle turbine driven electrical power generating system having a heat exchanger for vaporizing a working fluid; a vapor turbine having a rotating turbine wheel driven by said vaporized working fluid, a condenser for cooling and condensing said working fluid exhausted from said turbine; a feed pump having a rotating impeller for pumping the working fluid condensed in said condenser to said heat exchanger; and an induction electric generator having a rotor driven by said turbine for generating electric power; wherein the improvement comprises:

a hermetically sealed housing enclosing said turbine, said generator, and said feed pump;

said housing having a longitudinal axis oriented vertically;

a rotor assembly, including a single shaft extending along said longitudinal axis and having mounted thereon for rotation therewith said feed pump impeller, said generator rotor, and, at the lower axial end of said shaft, said turbine wheels;

a hydraulic support system for said rotor that further includes a source of pressurized liquid working fluid, a double acting tilt pad thrust bearing having a thrust runner connected to the shaft, and a casing enclosing the regions above and below the thrust runner so that said regions can be pressurized; and first and second fluid lines, respectively connected to the casing regions above and below the thrust runner, a spring loaded control valve in said first line that is normally biased to a closed position at the time the unit is initially started to pressurize the region below the thrust runner and thus support the rotor at start-up, said valve being automatically moved to an open position when the rotor reaches operating speed to pressurize both regions with fluid when the unit is running at operating speed.

9. The power unit defined in claim 8, wherein:

said housing has an axial exhaust directing said working fluid exhausted from said turbine axially downward;

whereby the reaction force of the downwardly flowing turbine exhaust is an upward force exerted on said turbine wheel which tends to support the weight of said shaft and the components mounted thereon.

10. The power unit defined in claim 8, wherein:

said shaft is supported radially by a pair of fluid film journal bearings, and supported axially by said double-acting thrust bearing, said bearings being contained in bearing cases which are filled with the Rankine cycle working fluid in a pressurized liquid state, which fluid serves as the bearing lubricant, thereby obviating the need for a separate lubricating oil system and shaft seals to separate lubricant fluid from cycle working fluid.

11. The power unit defined in claim 10, wherein:

said bearings are tilt pad bearings;

said bearing cases are connected, through a filter, to a source of pressurized liquid working fluid, at a pressure above the pressure within said hermetic housing, thus ensuring the continuity of a liquid lubricant film in the bearings.

12. The power unit defined in claim 11, wherein:

said source of pressurized working fluid is a boost pump having an outlet in fluid communication with the inlet of said feed pump to supply a pressurized suction head to said feed pump, and to supply a source of hydraulic pressure for a rotor thrust-bearing system.

13. The power unit defined in claim 12, wherein:

one of said journal bearings is axially above said generator and includes a restricted opening to the generator cavity for permitting liquid working fluid to cascade over the generator to cool it.

14. The power unit defined in claim 13, wherein the pressure within said generator cavity is maintained at the pressure of the system condenser to allow evaporative cooling of the generator by the leakage liquid cascading over it from the bearings and feed pump.

15. The power unit defined in claim 14, further comprising a vapor vent through said hermetic housing connected to a vapor line running to said condenser for conveying vaporized working fluid resulting from evaporative generator cooling from said hermetic housing to said condenser.

16. The power unit defined in claim 8, further comprising two seals and a drain groove in the periphery of said thrust runner and a vent hole in said casing communicating between said seals and the exterior of said casing to ensure that leakage of fluid through said seals does not pressurize the casing above said thrust runner.

17. The power unit defined in claim 8, further comprising a diffuser connected to the outlet of said turbine to recover some of the pressure of the working fluid in said turbine exhaust, said housing sitting directly on top of said diffuser, and said diffuser sitting directly on top of said condenser to eliminate exhaust vapor piping, minimize the transmission losses through the vapor lines, and produce a compact structure.

* * * * *